United States Patent [19]

Choschzick et al.

[11] 4,306,209

[45] Dec. 15, 1981

[54] SOUND-PROOFED CHOKE

[75] Inventors: Joachim Choschzick, Erlangen; Helmut Nieke, Berlin, both of Fed. Rep. of Germany

[73] Assignee: Siemens Aktiengesellschaft, Munich, Fed. Rep. of Germany

[21] Appl. No.: 189,770

[22] Filed: Sep. 23, 1980

[30] Foreign Application Priority Data

Sep. 28, 1979 [DE] Fed. Rep. of Germany ..... 2939533

[51] Int. Cl.[3] ..... H01F 27/02

[52] U.S. Cl. ..... 336/59; 336/100

[58] Field of Search ..... 336/59, 100, 92; 310/51; 181/202

[56] References Cited

U.S. PATENT DOCUMENTS 3,102,246 8/1963 Honey et al. ..... 336/100

4,146,112 3/1979 Usry ..... 336/100 X

*Primary Examiner*—Thomas J. Kozma

*Attorney, Agent, or Firm*—Kenyon & Kenyon

[57] ABSTRACT

A choke for use with alternating current has a ventilated housing with a perforate inner wall and an imperforate outer wall to which the choke is connected vibration-elastically. The space between the inner wall and the jacket is filled with a sound-absorbing material.

2 Claims, 1 Drawing Figure

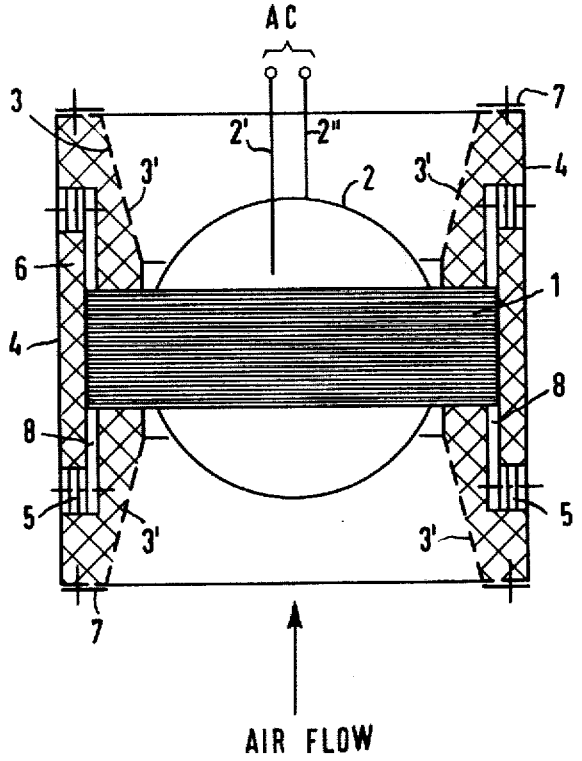
AC
3
2'
2"
7
3'
2
3'
4
6
1
4
8
8
5
3'
3'
5
7
AIR FLOW

SOUND-PROOFED CHOKE

BACKGROUND OF THE INVENTION

This invention relates to the damping of vibrations in an electric choke having a winding for use with alternating currents.

Various measures are used for attenuating the sound vibrations which are produced in the operation of electric chokes. One of these measures for reducing the sound level is to vacuum-impregnate the choke assembly or the stack of laminations in a vacuum. According to another method, sheets for covering the choke are sprayed with noise-deadening compound. Finally, chokes used in vehicles have been mounted on the floor of the carriage by means of rubber-to-metal mounts.

It is an object of the present invention to provide an air or iron core choke in which a distinct reduction of the solid-borne, as well as the air-borne, sound generated by the choke over the known designs, is achieved.

SUMMARY OF THE INVENTION

In accordance with the present invention, a choke to be used with alternating currents is mounted in a ventilated housing having a sound-permeable wall made with perforated plates, and an outer wall made with imperforate plates. The mounting of the choke is placed within the walls and is elastically coupled to the outer wall via semi-rigid, sound-absorbing bodies. Sound absorbent material fills the space around the supports in the space between the inner walls and the outer walls forming the housing jacket. Elastic end plates which do not transmit sound close the end faces between the inner walls and the housing jacket.

BRIEF DESCRIPTION OF THE DRAWINGS

The sole figure shows a choke fabricated in accordance with the invention.

DETAILED DESCRIPTION OF THE INVENTION

The sole figure shows an electrical choke which has an iron core 1 and a winding 2 which intended to be fed with an AC current by means of connection wires 2' and 2''.

The choke is arranged in a ventilated housing which has double walls. The inner housing wall 3, which is made sound-permeable by means of perforated plates 3', is rigidly fastened to the choke and guides the flow of air around choke core 2. An outer wall or jacket 4, made of imperforate plates, is provided at a predetermined distance from inner housing wall 3. The connection between iron core 1 and outer jacket 4 is made vibration-elastic by means of sound absorbing bodies 5 which may be rubber-metal elements, such as a sandwich, and are fastened, on the one hand to outer jacket 4 and, on the other hand, to the mounts or base plates 8 fastened on iron core 1. The space between inner housing wall 3 and outer jacket 4 is filled with sound-absorbing material 6.

Inner housing wall 3 and outer jacket 4 are both designed as ducts. The end faces between them are covered by elastic plates 7 which are fastened to a flange on either outer housing 4 or on inner housing wall 3, but not on both. In this manner, the presence of sound-conducting solid bridges between inner housing wall 3, which is fastened to the choke, and outer jacket 4 is avoided.

What is claimed is:

1. A sound-damped electric choke comprising:

a choke having a winding adapted for use with alternating currents and having a mount;

a housing through which ventilating air can pass, the housing comprising a perforate inner wall and an imperforate outer wall;

sound dampening means connecting the mount to the outer wall; and sound damping material in the space between the inner wall and the outer wall.

2. An electric choke in accordance with claim 1 further comprising:

elastic plates covering end faces of the housing between the inner and the outer wall.

* * * * *